US007887395B2

(12) United States Patent
Weiford et al.

(10) Patent No.: US 7,887,395 B2
(45) Date of Patent: Feb. 15, 2011

(54) SANDING TOOL WITH PIVOTALLY COUPLED HEAD ASSEMBLY

(75) Inventors: David W. Weiford, Parkville, MD (US); David Wiseman, O'Fallon, MO (US); Kenneth D. Long, Fallston, MD (US); Stuart J. Wright, Timonium, MD (US)

(73) Assignee: Black & Decker Inc., Newark, NJ (US)

( * ) Notice: Subject to any disclaimer, the term of this patent is extended or adjusted under 35 U.S.C. 154(b) by 55 days.

(21) Appl. No.: 12/463,066

(22) Filed: May 8, 2009

(65) Prior Publication Data

US 2009/0215365 A1 Aug. 27, 2009

Related U.S. Application Data

(63) Continuation of application No. 11/900,610, filed on Sep. 12, 2007, now Pat. No. 7,549,913.

(60) Provisional application No. 60/825,330, filed on Sep. 12, 2006.

(51) Int. Cl.
*B24B 23/00* (2006.01)

(52) U.S. Cl. ..... 451/359; 451/354; 451/456

(58) Field of Classification Search ..... 451/353, 451/354, 359, 456, 259
See application file for complete search history.

(56) References Cited

U.S. PATENT DOCUMENTS 2,854,829 A 10/1958 Porter
4,782,632 A 11/1988 Matechuk
5,144,774 A 9/1992 Conboy
5,160,299 A 11/1992 Sweeney
5,239,783 A 8/1993 Matechuk
5,545,080 A 8/1996 Clowers et al.
5,690,545 A 11/1997 Clowers et al.
5,885,145 A 3/1999 O'Mara
7,220,174 B2 5/2007 Phillips et al.
7,249,996 B1 7/2007 Volyar
7,275,981 B1 10/2007 Hurt et al.
7,384,328 B2 6/2008 Panfili
2006/0073778 A1 4/2006 Phillips et al.

OTHER PUBLICATIONS

International Search Report (PCT/US07/19777) dated Sep. 12, 2007.

*Primary Examiner*—Eileen P. Morgan
(74) *Attorney, Agent, or Firm*—Harness, Dickey & Pierce, P.L.C.

(57) ABSTRACT

A sanding tool includes a handle assembly with a support member and a head assembly that includes a sanding member that is rotatable relative to the handle assembly about a drive axis. The sanding tool also includes a pivot assembly that pivotably couples the head assembly to the support member of the handle assembly. The support member pivotably supports the pivot assembly, the drive axis extends through the pivot assembly, and the head assembly is pivotable about a plurality of different axes relative to the support member. The plurality of different axes includes an axis that is substantially aligned with the drive axis.

20 Claims, 5 Drawing Sheets

SANDING TOOL WITH PIVOTALLY COUPLED HEAD ASSEMBLY

CROSS-REFERENCE TO RELATED APPLICATIONS

This application is a continuation of U.S. patent application Ser. No. 11/900,610, filed Sep. 12, 2007, which claims the benefit of U.S. Provisional Application No. 60/825,330, filed Sep. 12, 2006, the entire disclosures of each incorporated herein by reference.

FIELD

The following relates to a sanding tool and, more particularly, relates to a sanding tool with a pivotally coupled head assembly.

BACKGROUND

The statements in this section merely provide background information related to the present disclosure and may not constitute prior art.

Sanding tools have been provided for various uses. For instance, drywall sanding tools have been provided for sanding joints between panels of drywall after the joints have been filled and taped. Typically, sanding tools include a handle assembly and a head assembly coupled to the handle. The head assembly includes a sanding member, such as a rotary sanding pad.

Conventional sanding tools suffer from certain disadvantages. For instance, during operation, the user typically holds the handle assembly and moves the head assembly over a relatively large sanding surface. Positioning the head assembly relative to the sanding surface can be awkward and cumbersome.

More specifically, in some conventional sanding tools, the head assembly is fixedly coupled to the handle assembly. As such, it can be difficult to maintain the head assembly level over the sanding surface as the head assembly is moved over the entire sanding surface. Thus, the user can inadvertently gouge the sanding surface during operation.

SUMMARY

A drywall sanding tool is disclosed that includes a handle assembly with a support member. The tool also includes a head assembly having a rotatable sanding pad that is rotatable relative to the handle assembly about a drive axis for sanding drywall. Also, the tool includes a pivot assembly that includes an outer pivot member and an inner pivot member. The pivot assembly pivotably couples the head assembly to the support member of the handle assembly, and the drive axis extends through both the outer pivot member and the inner pivot member. Furthermore, the outer pivot member is received by the support member to be pivotably supported by the support member, and the inner pivot member is fixedly coupled to the head assembly. Additionally, the inner pivot member is received in and is pivotably coupled to the outer pivot member such that the inner and outer pivot members are pivotable relative to each other and such that the head assembly is pivotable about a plurality of different axes, each of which having a common center point, relative to the support member. The plurality of different axes include an axis that is substantially aligned with the drive axis.

A sanding tool is also disclosed that includes a handle assembly with a support member and a head assembly that includes a sanding member that is rotatable relative to the handle assembly about a drive axis. The sanding tool also includes a pivot assembly that pivotably couples the head assembly to the support member of the handle assembly. The support member pivotably supports the pivot assembly, the drive axis extends through the pivot assembly, and the head assembly is pivotable about a plurality of different axes relative to the support member. The plurality of different axes includes an axis that is substantially aligned with the drive axis.

Furthermore, a drywall sanding tool is disclosed that includes a handle assembly with a support member. The tool further includes a head assembly that includes a rotatable sanding pad that is rotatable relative to the handle assembly about a drive axis to sand drywall. In addition, the tool includes a pivot assembly that pivotably couples the head assembly to the support member of the handle assembly. The support member pivotably supports the pivot assembly, and the drive axis extends through the pivot assembly. Also, the head assembly is pivotable about a plurality of different axes relative to the support member including an axis that is substantially aligned with the drive axis.

DRAWINGS

The drawings described herein are for illustration purposes only and are not intended to limit the scope of the present disclosure in any way.

DETAILED DESCRIPTION

Figure 1:
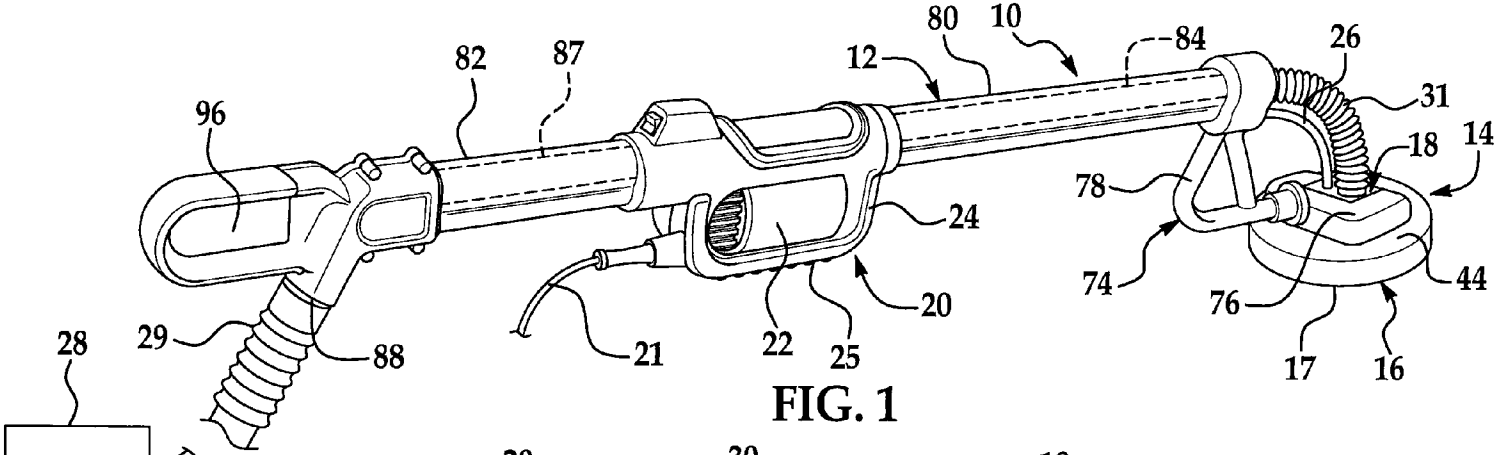
FIG. 1 is a perspective view of one embodiment of a sanding tool according to the present disclosure.

The following description is merely exemplary in nature and is not intended to limit the present disclosure, application, or uses. It should be understood that throughout the drawings, corresponding reference numerals indicate like or corresponding parts and features.

Referring initially to FIG. 1, one embodiment of a sanding tool 10 is illustrated. More specifically, in the embodiment shown, the sanding tool 10 is a drywall sander for various uses, including sanding joints between sheets of drywall (not shown).

Generally, the sanding tool 10 includes a handle assembly 12 and a head assembly 14 that includes a sanding member 16. During operation, the sanding member 16 moves and is placed against a sanding surface (not shown) to perform a sanding operation thereon. In one embodiment, the sanding member 16 is a rotatable sanding pad 17 that will be described in greater detail below.

The sanding tool 10 further includes at least one pivot member 18 that pivotably couples the handle assembly 12 and the head assembly 14 such that the head assembly 14 is pivotable about a plurality of different axes relative to the handle assembly 12 as will be described in greater detail below.

The sanding tool 10 also generally includes a motor assembly 20. In the embodiment shown, the motor assembly 20 includes a motor 22, such as a brushless motor, and a housing 24 that encapsulates the motor 22 and couples the motor 22 to the handle assembly 12. The motor assembly 20 also includes a power cord 21 that supplies power to the motor 22. In the embodiment shown, the housing 24 of the motor assembly 20 is shaped to include a grip portion 25. The grip portion 25 provides a convenient location to grip and hold the sanding tool 10. The motor assembly 20 also includes a flexible and rotatable shaft 26 that is operably coupled to the motor 22. The shaft 26 extends from the housing 24 along the handle assembly 12 and is drivingly coupled to the sanding member 16 in a manner to be described in greater detail below. As such, the motor 22 drivingly rotates the sanding member 16 via the shaft 26.

The sanding tool 10 is operably coupled to a vacuum device 28, which generates a suction force. The sanding tool 10 also includes a front vacuum tube 31. The front vacuum tube 31 is in fluid communication with an interior portion of the deck 44 adjacent the sanding pad 17 and the vacuum device 28. During operation, dust and other materials are sucked through the front vacuum tube 31 and into the vacuum device 28 as will be discussed in greater detail below. In one embodiment, the sanding tool 10 is removably coupled to the vacuum device 28 via a vacuum tube 29.

Figure 2:
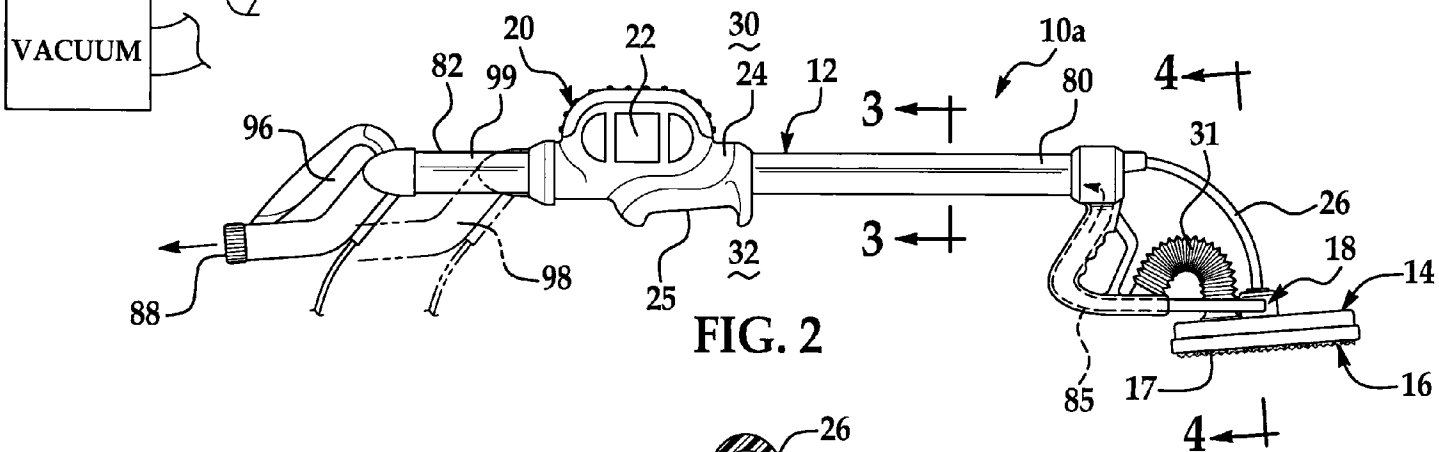
FIG. 2 is a side view of another embodiment of a sanding tool according to the present disclosure.

Referring now to FIG. 2, another embodiment of the sanding tool 10*a* is shown. The embodiment of FIG. 2 is substantially similar to the embodiment of FIG. 1 with some exceptions detailed below.

For instance, in the embodiment of FIG. 2, the handle assembly 12 of the sanding tool 10*a* defines a first side 30 and a second side 32. The first side 30 and second side 32 are on opposite sides of the longitudinal axis of the handle assembly 12. As shown, the head assembly 14 is on the second side 32 of the handle assembly 12, and the motor assembly 20 is on the first side 30 of the handle assembly 12.

As such, the motor assembly 20 and the head assembly 14 are on opposite sides of the longitudinal axis of the handle assembly 12. Thus, the center of gravity of the sanding tool 10*a* is at a more convenient location nearer the body of the sanding tool 10*a*. This feature allows the user to more easily balance the sanding tool 10*a* while holding the sanding tool 10*a*. In one embodiment, the motor assembly 20 and head assembly 14 are balanced such that the center of gravity of the sanding tool 10*a* is located within the handle assembly 12 between the motor assembly 20 and the head assembly 14.

Figure 4:
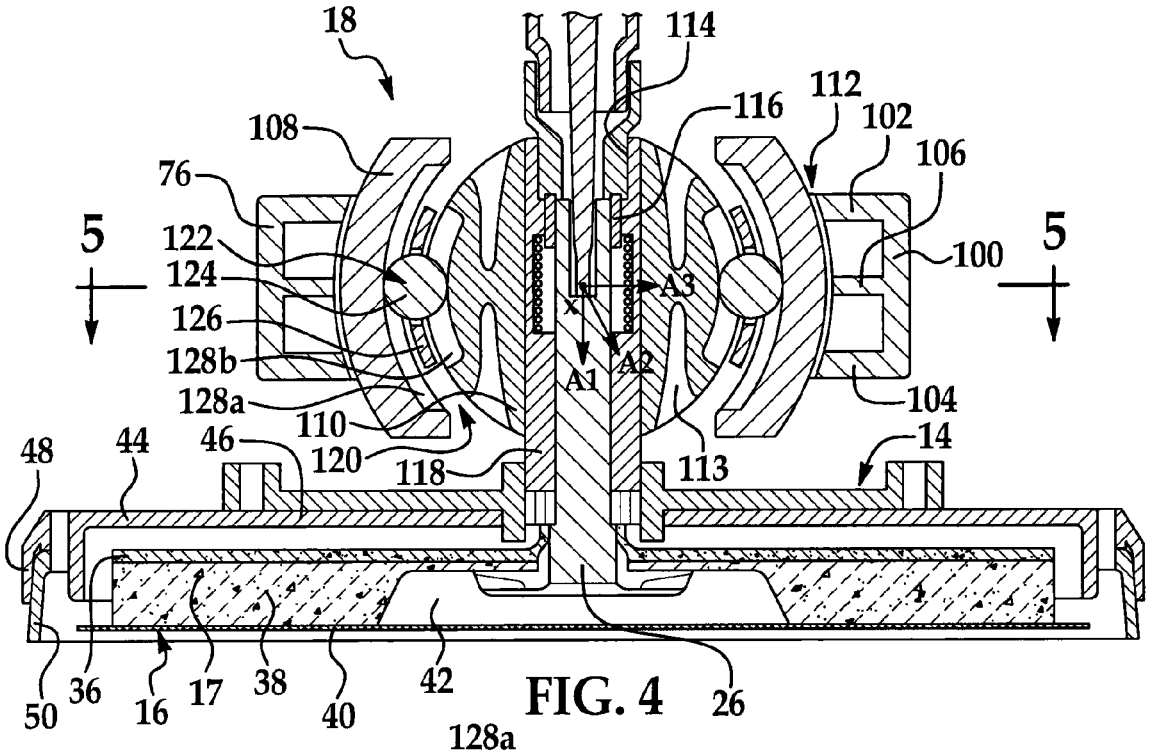
FIG. 4 is a section view of the sanding tool of FIG. 2, taken along the line 4-4.

Referring now to FIGS. 4 and 6-8, the head assembly 14 will be explained in more detail. As stated the above, the head assembly 14 includes a sanding member 16, such as a rotatable sanding pad 17 (FIG. 4). The sanding pad 17 includes a backing member 36, an intermediate member 38, and a sand paper sheet 40. The intermediate member 38 is made of foam in one embodiment. The intermediate member 38 is provided between the backing member 36 and the sand paper sheet 40. The sand paper sheet 40 includes a grit surface for sanding the sanding surface (not shown). The sanding pad 17 is substantially disk shaped and includes a recess 42 near its center as shown in FIG. 4. The shaft 26 extends through the sanding pad 17 into the recess 42 and is coupled to the sanding pad 17 therein.

The head assembly 14 also includes a deck 44. The deck 44 includes an upper plate 46 and an outer ring 48, which extends from one side of the outer periphery of the upper plate 46. In one embodiment, the deck 44 is made out of a relatively hard plastic. The deck 44 substantially encloses the sanding pad 17, leaving the sand paper sheet 40 exposed within the outer ring 48.

Figure 6:
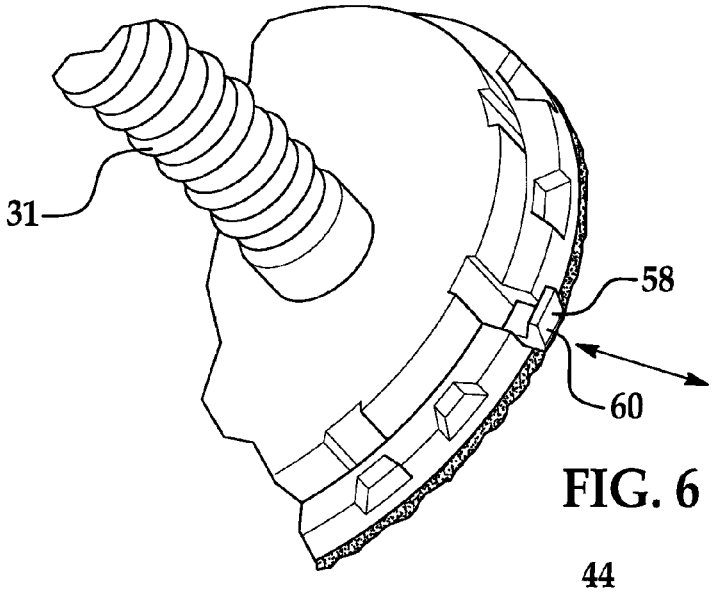
FIG. 6 is a perspective view of a portion of the head assembly of the sanding tool according to the present disclosure.
Figure 7:
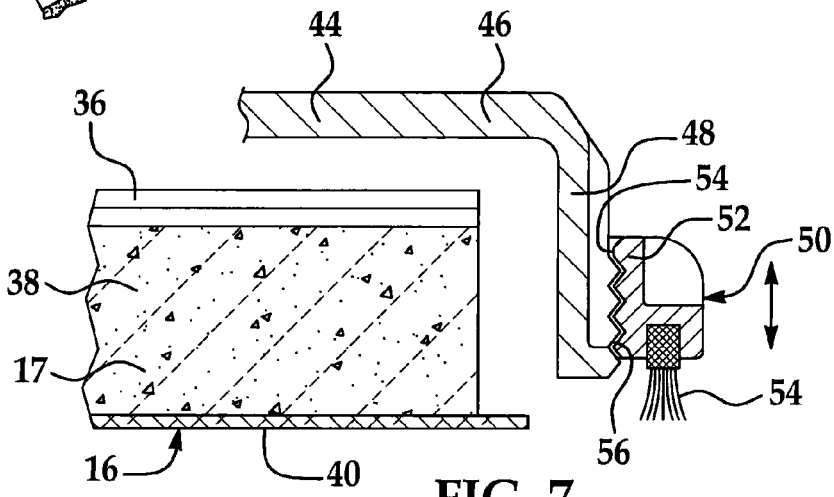
FIG. 7 is a section view of the head assembly.
Figure 8:
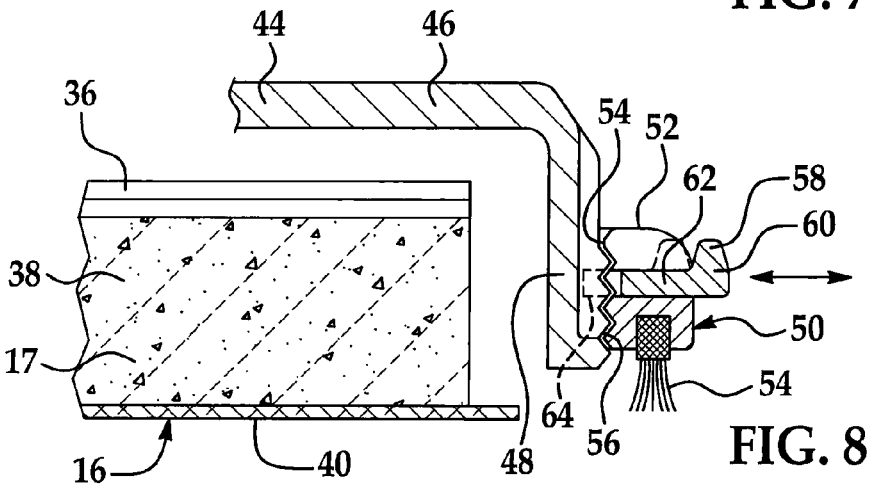
FIG. 8 is a section view of the head assembly.

The head assembly 14 further includes a brush ring assembly 50. In the embodiment of FIGS. 6-8, the brush ring assembly 50 includes an upper support 52, which is ring shaped, and a brush member 54, which has a plurality of bristles that extend from the upper support 52 of the brush ring assembly 50.

The upper support 52 of the brush ring assembly 50 is threaded on its inner surface along an axial direction of the upper support 52 (FIGS. 7 and 8). Likewise, the outer ring 48 of the deck 44 is threaded on an outer surface 56 along an axial direction of the deck 44. As such, the brush ring assembly 50 is threadably engaged to the deck 44.

In order to adjust the axial height of the brush ring assembly 50 relative to the deck 44, the user threadably advances the brush ring assembly 50 in either axial direction relative to the deck 44. As such, the user can quickly and easily adjust the height of the brush ring assembly 50. Thus, the brush member 54 is less likely to interfere with the placement of the sanding pad 17 against the sanding surface (not shown).

Furthermore, in the embodiment shown in FIGS. 6-8, the head assembly 14 includes at least one locking device 58. In the embodiment shown, the locking device 58 includes a removably attached peg 60 that extends through a corresponding aperture 62 in the brush ring assembly 50 and into a corresponding aperture 64 of the deck 44. The locking device 58 thus retains the brush ring assembly 50 in the desired axial position.

Figure 9:
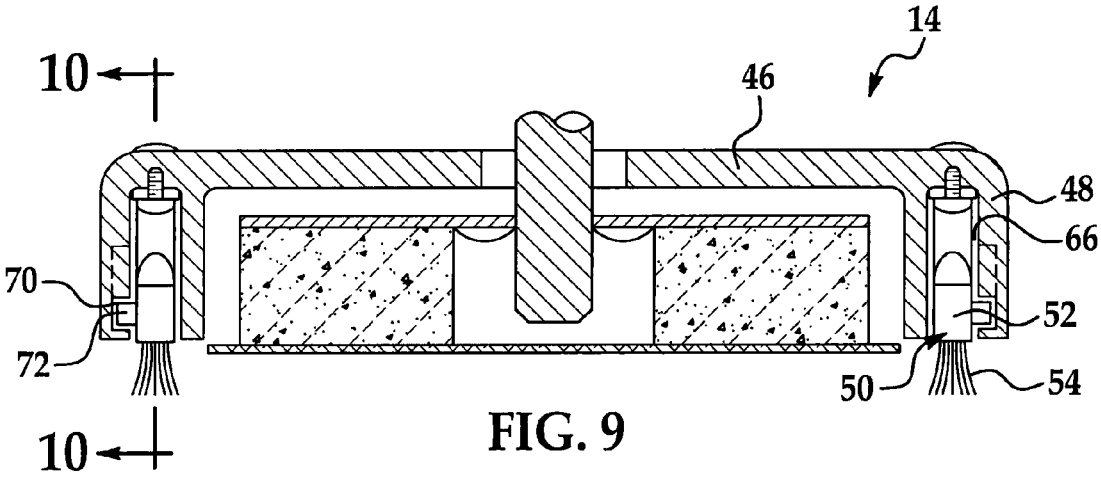
FIG. 9 is a section view of the head assembly.
Figure 10:
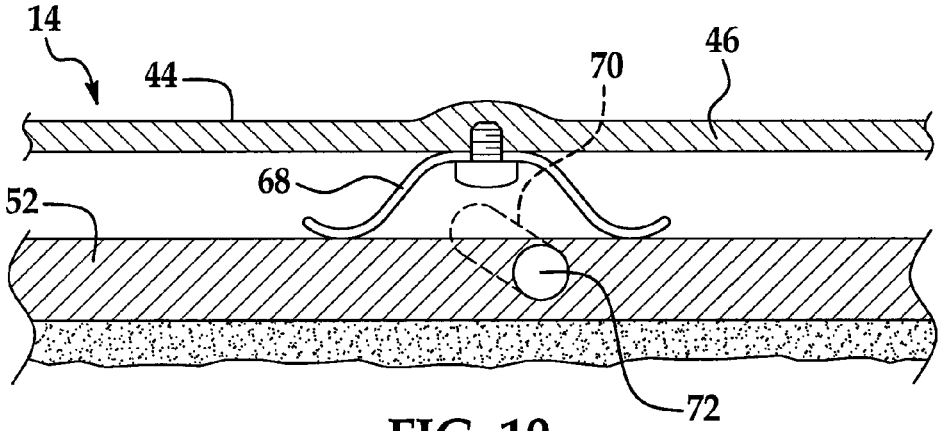
FIG. 10 is a section view of the head assembly.

Referring now to FIGS. 9 and 10, an alternative embodiment is shown. In this embodiment, the outer ring 48 of the deck 44 includes a channel 66 extending circumferentially about the outer ring 48. The brush ring assembly 50 is provided within the channel 66, and the bristles of the brush member 54 extend from the channel 66.

Also, as shown in FIG. 10, the head assembly 14 includes at least one biasing member 68. In one embodiment, there is a plurality of biasing members 68 spaced equally around the axis of the deck 44. Also, in the embodiment shown, the biasing member 68 is coupled to the upper plate 46 of the deck 44. More specifically, in the embodiment shown, the biasing member 68 is a leaf spring that resiliently biases against the upper support 52 of the brush ring assembly 50. The biasing force of the biasing member 68 is applied to the brush ring assembly 50 in a direction away from the deck 44.

Moreover, the head assembly 14 includes at least one slot 70, and at least one corresponding pin 72. In the embodiment shown, the slot 70 is disposed at an angle relative to the axis of the brush ring assembly 50. Also, in the embodiment shown, the slot 70 is provided on an inner surface of the channel 66, and the corresponding pin 72 is fixedly coupled to the upper support 52 of the brush ring assembly 50. The pin 72 extends from the upper support 52 and into the slot 70. The pin 72 moves within the slot 70, and this movement of the pin 72 within the slot 70 guides the movement of the brush ring assembly 50 due to the biasing force provided by the biasing member 68 such that the brush ring assembly 50 remains level with respect to the deck 44.

During operation, as the user presses the head assembly 14 against the sanding surface (not shown), the brush ring assembly 50 is pushed by the sanding surface further into the channel against the biasing force of the biasing member 68. The biasing member 68 provides a predetermined amount of biasing force to the brush ring assembly 50. The biasing force provided by the biasing member 68 is opposed to the force applied by the sanding surface. Because of the biasing member 68, the brush ring assembly 50 is less likely to interfere with the contact of the sanding pad 17 against the sanding surface (not shown) because the axial position of the brush ring assembly 50 automatically adjusts according to the predetermined biasing force.

Figure 11:
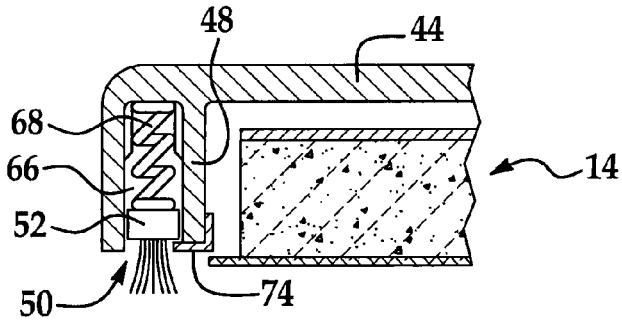
FIG. 11 is a section view of another embodiment of the head assembly.

FIG. 11 shows another embodiment of the biasing member 68. In the embodiment shown, the biasing member 68 is a compression spring extending from an upper surface of the channel 66 to the upper support 52 of the brush ring assembly 50. The head assembly 14 further includes a stop member 74. In the embodiment shown, the stop member 74 is ring shaped. The stop member 74 is coupled to the deck 44. More specifically, the stop member 74 extends from the outer ring 48 of the deck 44 and into the channel 66. As such, the stop member 74 interferes with movement of the brush ring assembly 50 out of the channel 66. Like the embodiment of FIGS. 9 and 10, the axial position of the brush ring assembly 50 automatically adjusts relative to the sanding pad 17 such that the brush ring assembly 50 is less likely to interfere with contact of the sanding pad 17 against the sanding surface (not shown).

Referring now to FIGS. 1 and 2, the handle assembly 12 will be described in greater detail. The handle assembly 12 generally includes a front handle portion 74, an intermediate handle portion 80, and a rear handle portion 82. In the embodiment shown, the intermediate and rear handle portions 80, 82 have a substantially straight axis.

The front handle portion 74 is located adjacent to the deck 44 and can be used to hold the sanding tool 10, 10*a* with a great deal of control. In the embodiment shown, the front handle portion 74 includes a support member 76 that is coupled to the pivot member 18 in a manner to be described below. The front handle portion 74 also includes a grip portion 78 that is U-shaped and is relatively stiff. One end of the grip portion 78 is fixed to the support member 76.

Also, one end of the intermediate handle portion 80 of the handle assembly 12 is fixed to the grip portion 78. An opposite end of the intermediate handle portion 80 is fixed to the housing 24 of the motor assembly 20.

The rear handle portion 82 is also coupled to the housing 24 of the motor assembly 20. The rear handle portion 82 extends from an end of the housing 24 opposite to the intermediate handle portion 80.

Figure 3:
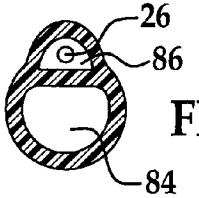
FIG. 3 is a section view of the sanding tool of FIG. 2, taken along the line 3-3.

Each of the intermediate handle portion 80 and rear handle portion 82 include at least one passage extending axially therethrough. More specifically, in the embodiment shown in FIG. 3, the intermediate handle portion 80 includes a vacuum passage 84 and a separate shaft passage 86.

The vacuum passage 84 is in fluid communication with the front vacuum tube 31. Also, in the embodiment shown in FIG. 2, the front handle portion 74 includes a vacuum passage 85 that fluidly couples the front vacuum tube 31 and the vacuum passage 84 of the intermediate handle portion 80. In each of the embodiments shown in FIGS. 1 and 2, the rear handle portion 82 includes a vacuum passage 87, which fluidly couples the vacuum passage 84 of the intermediate handle portion 80 and the vacuum tube 29 of the vacuum device 28.

During operation of the sanding tool 10, 10*a*, dust produced and contained within the deck 44 is sucked into the front vacuum tube 31, through the vacuum passage 84 of the intermediate handle portion 80, through the vacuum passage 87 of the rear handle portion 82, through an exit aperture 88 defined in the rear handle portion 82, out of the sanding tool 10, 10*a*, and is collected by the vacuum device 28.

The shaft 26 of the motor assembly 20 extends away from the motor 22 along the axis of the shaft passage 86. It will be appreciated that the passage 86 could be used to encapsulate an electric cord or another component of the sanding tool 10, 10*a*. During operation, dust and other debris flow to the vacuum device 28 independent of the shaft 26. Thus the shaft 26 is unlikely to malfunction due to dust exposure.

Figure 12:
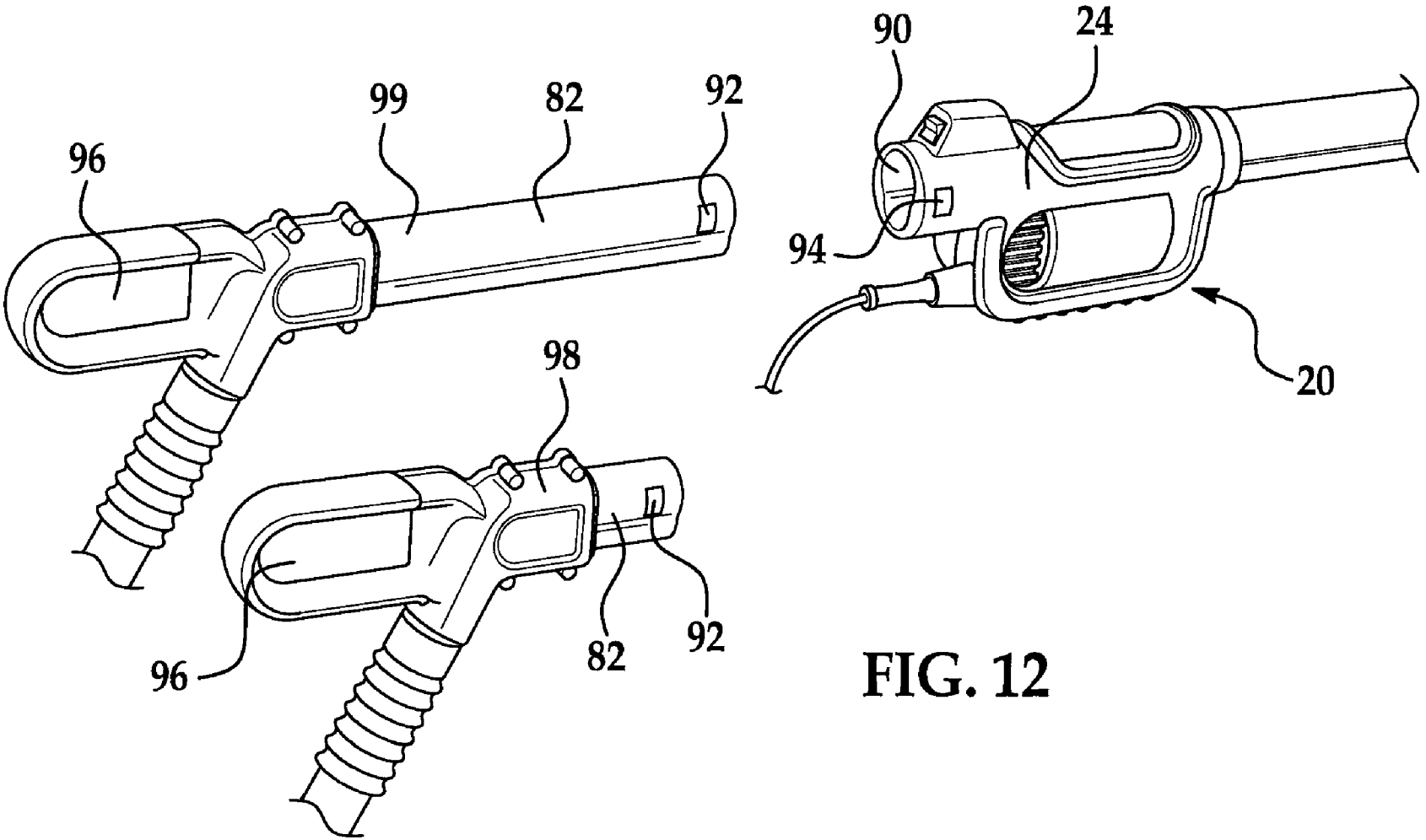
FIG. 12 is a perspective view of the handle assembly of the sanding tool according to the present disclosure.

Referring now to FIGS. 1, 2, and 12, the rear handle portion 82 is shown in greater detail. As shown, the rear handle portion 82 is detachably and interchangeably coupled to the housing 24 of the motor assembly 20. More specifically, the rear handle portion 82 slides into and out of a corresponding aperture 90 of the housing 24. In the embodiment shown, the rear handle portion 82 further includes a slot 92, and the housing 24 includes a pin 94 that biases into the slot 92 to thereby retain the rear handle portion 82 onto the housing 24.

The rear handle portion 82 further includes an opening 96. The opening 96 provides a convenient location to hold and grip the rear handle portion 82.

In one embodiment, the sanding tool 10, 10*a* includes a plurality of rear handle portions 82 of different axial lengths as represented in FIG. 12. In the embodiment shown, the sanding tool 10, 10*a* includes a shorter rear handle portion 98 and a longer rear handle portion 99. As such, the rear handle portions 98, 99 can be interchanged depending on the conditions of the sanding operation. For instance, if the sanding tool 10, 10*a* is intended to be used to sand above and out of reach of the user (e.g., sanding near a ceiling), the longer rear handle portion 99 can be attached to the housing 24 of the motor assembly 20 to allow the head assembly 14 to reach the sanding area (not shown). However, if the sanding surface (not shown) is located in close quarters (e.g., sanding in a closet) the shorter rear handle portion 98 can be attached to the housing 24 of the motor assembly 20. Thus, the detachable and interchangeable rear handle portion 99 increases the usefulness of the sanding tool 10, 10*a*. Also, because the rear handle portion 99 is detachable, the sanding tool 10, 10*a* is more compact for packaging and storage. Furthermore, the sanding tool 10, 10*a* can be sold in separate parts.

Referring now to FIG. 4, one embodiment of the pivot member 18 is shown in greater detail. As stated above, the handle assembly includes a support member 76. The support member 76 is pivotally attached to the pivot member 18.

As shown in FIG. 4, the handle assembly 12 includes an outer wall 100, an upper wall 102, a lower wall 104, and an intermediate wall 106. The outer wall 100 extends substantially perpendicular to the upper, lower, and intermediate walls 102, 104, 106. The intermediate wall 106 is provided between the upper and lower walls 102, 104.

The pivot member 18 includes an outer pivot member 108 and an inner pivot member 110. In the embodiment shown, the outer pivot member 108 is pivotally attached to the support member 76 of the handle assembly 12, and the outer pivot member 108 is fixedly coupled to the deck 44 of the head assembly 14.

The outer pivot member 108 is substantially hollow and partially spherical in the embodiment shown. The outer pivot member 108 is pivotably coupled to the support member 76 in the embodiment shown. More specifically, the outer pivot member 108 is received in the support member 76 between the upper, lower, and intermediate walls 106 so as to be rotatable therein. The ends of the upper, lower, and intermediate walls 106 are rounded so as to correspond to the outer surface profile of the outer pivot member 108. As such, the outer pivot member 108 is able to pivot within the support member 76. In other words, the support member 76 and the outer pivot member 108 cooperate to define a first ball-and-socket joint 112. As such, the outer pivot member 108 can pivot relative to the support member 76 about a plurality of different axes, A1, A2, A3, each of which have a common center point X. In the embodiment shown, outer pivot member 108 pivots about a center point X that is located approximately at the center of the outer pivot member 108.

The inner pivot member 110 is substantially hollow and spherical in shape. The inner pivot member 110 includes a plurality of recesses 113 that increase the manufacturability of the inner pivot member 110. For instance, the recesses 113 facilitate molding of the inner pivot member 110. The inner pivot member 110 includes an aperture 114 extending therethrough. The shaft 26 of the motor assembly 20 extends through the aperture 114 to drivingly couple to the sanding pad 17. A bushing 116 is fixed to the inner pivot member 110 within the aperture 114 to support the shaft 26 for rotation. Also, a casing 118 is fixed to the inner pivot member 110 within the aperture 114, and the casing 118 is fixed to the upper plate 46 to thereby fixedly couple the inner pivot member 110 to the deck 44 of the head assembly 14.

The inner pivot member 110 is received within and is coupled to the outer pivot member 108 so as to define a second ball-and socket joint 120. Thus, the inner pivot member 110 is able to rotate relative to the outer pivot member 108. More specifically, the inner pivot member 110 can pivot relative to the outer pivot member 108 about a plurality of different axes, A1, A2, A3, each of which have a common center point X. In the embodiment shown, the inner pivot member 110 pivots about a center point X that is located approximately at the center of the inner pivot member 108. In the embodiment shown, the inner and outer pivot members 108, 110 pivot about a common center point X; however, it will be appreciated that the inner and outer pivot members 108, 110 could pivot about respective center points that are disposed in spaced relationship to each other.

The pivot member 18 further includes at least one bearing 122. In the embodiment shown, the bearing 122 includes a plurality of bearing balls 124 and a cage 126 that couples the bearing balls 124. The bearing 122 is provided between the outer pivot member 108 and the inner pivot member 110 to facilitate relative rotation thereof.

Figure 5:
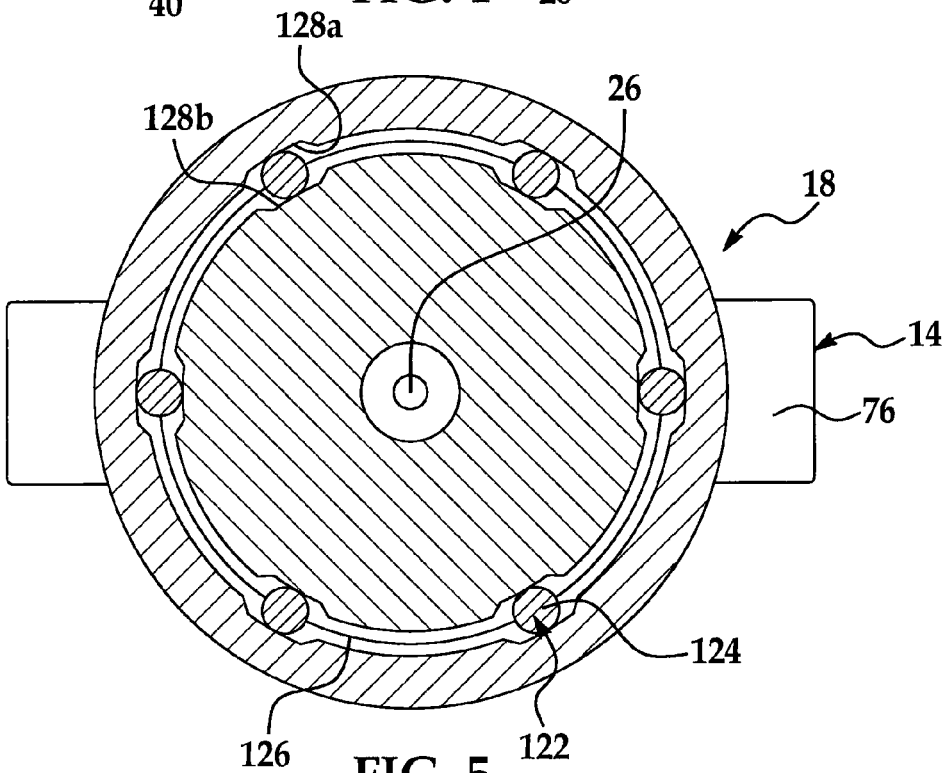
FIG. 5 is a section view of the sanding tool of FIG. 2, taken along the line 5-5.

Furthermore, in the embodiment shown, an inner surface of the outer pivot member 108 includes a bearing path 128, and an outer surface of the inner pivot member 110 includes a corresponding bearing path 128*b*. As shown in FIG. 5, the pivot member 18 includes a plurality of separate pairs of bearing paths 128*a*, 128*b*. The bearing balls 124 are each moveably retained within individual pairs of the bearing paths 128*a*, 128*b*. The bearing paths 128*a*, 128*b* can be of any suitable shape. The pivoting movement of the inner pivot member 110 relative to the outer pivot member 108 is limited by the shape of the bearing paths 128*a*, 128*b*.

Thus, the head assembly 14 is pivotable relative to the handle assembly 12 of the sanding tool 10, 10*a* about a plurality of axes via the pivot member 18. As such, the head assembly 14 has a wide degree of freedom to adjust to the angle of the sanding surface (not shown) such that the head assembly 14 is more likely to remain level on the sanding surface for improved sanding operation. Accordingly, handling of the sanding tool 10, 10*a* is less awkward and cumbersome, and the sanding surface is less likely to be gouged during sanding operation.

It will be appreciated that the pivot member 18 could have several different features from the illustrated embodiments without departing from the scope of the present disclosure. For instance, the pivot member 18 could include only one of the outer pivot member 108 and the inner pivot member 110 such that the sanding tool 10, 10*a* includes only one ball-and-socket joint. Furthermore, in another embodiment, the outer pivot member 108 could be fixed to the head assembly 14, and inner pivot member 110 could be pivotally attached to the handle assembly 12.

The present disclosure has been described in an illustrative manner. It is to be understood that the terminology which has been used is intended to be in the nature of words of description rather than of limitation. Many modifications and variations are possible in light of the above teachings. Therefore, within the scope of the appended claims, the present disclosure may be practiced other than as specifically described.

What is claimed is:

1. A drywall sanding tool comprising:

a handle assembly with a proximal end and a distal end, the handle assembly including a stationary support member at the distal end;

a head assembly that includes a rotatable sanding pad that is rotatable relative to the handle assembly about a drive axis for sanding drywall; and a pivot assembly that includes an outer pivot member and an inner pivot member, the pivot assembly pivotably coupling the head assembly to the support member of the handle assembly, the drive axis extending through both the outer pivot member and the inner pivot member, the outer pivot member being received by the support member to be pivotably supported by the support member; and the inner pivot member being fixedly coupled to the head assembly, the inner pivot member being received in and pivotably coupled to the outer pivot member such that the inner and outer pivot members are pivotable relative to each other and such that the head assembly is pivotable about a plurality of different axes, each of which having a common center point, relative to the support member, the plurality of different axes including an axis that is substantially aligned with the drive axis.

2. A sanding tool comprising:

a handle assembly with a proximal end and a distal end, the handle assembly including a stationary support member at the distal end;

a head assembly that includes a sanding member that is rotatable relative to the handle assembly about a drive axis; and a pivot assembly that pivotably couples the head assembly to the support member of the handle assembly, the support member pivotably supporting the pivot assembly, the drive axis extending through the pivot assembly, the head assembly pivotable about a plurality of different axes relative to the support member, the plurality of different axes including an axis that is substantially aligned with the drive axis.

3. The sanding tool of claim 2, further comprising at least one ball and socket joint.

4. The sanding tool of claim 3, wherein the support member and the pivot assembly cooperate to define the at least one ball and socket joint.

5. The sanding tool of claim 4, wherein the support member and the pivot assembly cooperate to define a first ball and socket joint, and the pivot assembly includes a second ball and socket joint.

6. The sanding tool of claim 2, wherein the pivot assembly includes an outer pivot member that is pivotably supported by the support member, wherein the pivot assembly further includes an inner pivot member that is coupled to the head assembly, and wherein the inner pivot member is pivotably coupled to the outer pivot member such that the inner and outer pivot members are pivotable relative to each other.

7. The sanding tool of claim 6, wherein the inner pivot member is received in the outer pivot member so as to be rotatable therein, and wherein the outer pivot member is received in the support member so as to be rotatable therein.

8. The sanding tool of claim 7, further comprising at least one bearing provided between the outer pivot member and the inner pivot member.

9. The sanding tool of claim 8, wherein the outer pivot member includes an inner surface defining at least one bearing path, wherein the inner pivot member includes an outer surface defining at least one bearing path, and wherein the at least one bearing is provided within the at least one bearing path of the outer pivot member and within the at least one bearing path of the inner pivot member.

10. The sanding tool of claim 2, wherein the pivot assembly pivotably couples the head assembly to the support member of the handle assembly such that the head assembly is pivotable about a plurality of different axes relative to the support member, each of which have a common center point.

11. The sanding tool of claim 2, further comprising a motor having a flexible and rotatable shaft, wherein the shaft is drivingly coupled to the sanding member of the head assembly, and wherein the shaft extends through the pivot assembly and is at least partially aligned with the drive axis.

12. A drywall sanding tool comprising:

a handle assembly with a proximal end and a distal end, the handle assembly including a stationary support member at the distal end;

a head assembly that includes a rotatable sanding pad that is rotatable relative to the handle assembly about a drive axis to sand drywall; and a pivot assembly that pivotably couples the head assembly to the support member of the handle assembly, the support member pivotably supporting the pivot assembly, the drive axis extending through the pivot assembly, the head assembly pivotable about a plurality of different axes relative to the support member, the plurality of different axes including an axis that is substantially aligned with the drive axis.

13. The drywall sanding tool of claim 12, further comprising at least one ball and socket joint.

14. The drywall sanding tool of claim 13, wherein the support member and the pivot assembly cooperate to define the at least one ball and socket joint.

15. The drywall sanding tool of claim 14, wherein the support member and the pivot assembly cooperate to define a first ball and socket joint, and the pivot assembly includes a second ball and socket joint.

16. The drywall sanding tool of claim 12, wherein the pivot assembly includes an outer pivot member that is pivotably supported by the support member, wherein the pivot assembly further includes an inner pivot member that is coupled to the head assembly, and wherein the inner pivot member is pivotably coupled to the outer pivot member such that the inner and outer pivot members are pivotable relative to each other.

17. The drywall sanding tool of claim 16, wherein the inner pivot member is received in the outer pivot member so as to be rotatable therein, and wherein the outer pivot member is received in the support member so as to be rotatable therein.

18. The drywall sanding tool of claim 16, further comprising at least one bearing provided between the outer pivot member and the inner pivot member.

19. The drywall sanding tool of claim 18, wherein the outer pivot member includes an inner surface defining at least one bearing path, wherein the inner pivot member includes an outer surface defining at least one bearing path, and wherein the at least one bearing is provided within the at least one bearing path of the outer pivot member and within the at least one bearing path of the inner pivot member.

20. The drywall sanding tool of claim 12, wherein the pivot assembly pivotably couples the head assembly to the support member of the handle assembly such that the head assembly is pivotable about a plurality of different axes relative to the support member, each of which have a common center point.

* * * * *